US006205290B1

(12) United States Patent
Hung et al.

(10) Patent No.: US 6,205,290 B1
(45) Date of Patent: Mar. 20, 2001

(54) ELECTRIC HEATER WITH HEAT SINK MEMBERS

(75) Inventors: Chin-Ping Hung, Chung-Li; Ting-Chien Lu, Chung Li, both of (TW)

(73) Assignee: Eastpearl Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/400,908

(22) Filed: Sep. 22, 1999

(51) Int. Cl.[7] ..... F24H 3/00

(52) U.S. Cl. ..... 392/373; 392/347; 165/128; 219/530

(58) Field of Search ..... 392/373, 374, 392/354, 347; 219/530, 540; 165/128, 131, 129

(56) References Cited

U.S. PATENT DOCUMENTS

| | | | | |
|---|---|---|---|---|
| Re. 17,857 | * | 11/1930 | Burgher | 392/354 |
| 1,633,601 | * | 6/1927 | Murray | 165/129 |
| 1,716,459 | * | 6/1929 | Phelps et al. | 219/530 |
| 1,731,472 | * | 10/1929 | Murray | 219/530 |
| 2,007,222 | * | 7/1935 | Soverhill | 219/540 |
| 2,170,176 | * | 8/1939 | Wiegand | 219/530 |
| 2,432,400 | * | 12/1947 | Eger | 219/540 |
| 2,892,065 | * | 6/1959 | Persak, Jr. | 392/347 |
| 2,967,225 | * | 1/1961 | Carrier et al. | 219/540 |
| 3,010,091 | * | 11/1961 | Sawyer | 219/530 |
| 3,740,527 | * | 6/1973 | Roffelsen | 219/530 |

FOREIGN PATENT DOCUMENTS

| | | | | |
|---|---|---|---|---|
| 574264 | * | 4/1959 | (CA) | 392/373 |
| 847483 | * | 7/1970 | (CA) | 219/540 |
| 220461 | * | 7/1942 | (CH) | 392/373 |
| 1090351 | * | 10/1960 | (DE) | 392/373 |
| 1115901 | * | 10/1961 | (DE) | 392/347 |
| 498334 | * | 1/1920 | (FR) | 392/354 |
| 2381976 | * | 9/1978 | (FR) | 219/540 |
| 577916 | * | 6/1946 | (GB) | 392/347 |
| 617606 | * | 2/1949 | (GB) | 392/347 |
| 1034594 | * | 6/1966 | (GB) | 219/530 |

* cited by examiner

*Primary Examiner*—John A. Jeffery
(74) *Attorney, Agent, or Firm*—Bacon & Thomas

(57) ABSTRACT

An electric heater includes a receiving chamber, heat sink members, electric heating pipes and a control portion. The receiving chamber and heat sink members are formed from extruded aluminum members. The heat sink members are sequentially arranged at both sides of the receiving chamber. The electric heating pipes are placed in the receiving chamber. The control unit activates an electric power source of the electric heating pipes in order to generate heat. Heat energy from the electric heating pipes is absorbed by extruded aluminum plates that define the receiving chamber. Heat energy is conducted quickly to the heat sink members which exchanges heat by convection with ambient cool air to rapidly raise the temperature of a room.

5 Claims, 11 Drawing Sheets

ELECTRIC HEATER WITH HEAT SINK MEMBERS

BACKGROUND OF THE INVENTION

1. Field of the Invention

The present invention is related to an electric heater made from extruded aluminum members. The electric heater is light in weight, easily assembled, low in cost and quick in heating.

2. Description of the Prior Art

The general methods of increasing indoor temperature by heating conventionally includes "heating by radiation" and "heating by hot air convection". The burning of wood in a fireplace causes fire to emit heat into the ambient air via heat radiation. A heater that generates heat energy by burning wood can raise the temperature of ambient air around the heater and thus the temperature of a room as well by hot air convection.

As shown in FIG. 1, in a conventional electric heater, an arciform stainless steel plate 2 is provided in front of an iron housing 1. The stainless steel plate 2 is provided in a concave recess thereof with a plurality of quartz pipes 3. The quartz pipes 3 emit infrared light having heat energy after becoming electrically energized; the light is reflected by the stainless steel plate 2 to heat the area in front of the electric heater.

Such an electric heater is capable of generating radiation heat that is low in cost and in a short period of time. However, during the emission of heat, only the areas where the body of a person receives light can feel the warmth, and when the person receives the light for a prolonged period, dryness and discomfort for the user ensues.

As is shown in FIG. 2, a conventional convective electric heater that uses air convection to heat includes a heating portion 4, a connecting pipe line (not shown) and steel plates 5. The heating portion 4 is provided with a heater and a pump, and low-volatile oil stored therein. The oil can be heated gradually by the heater, and is delivered by the pump to the connecting pipe line to cause the cold oil in the connecting pipe line to be sent hack to the heating portion 4, thereby forming a circulation flow. The connecting pipe line is connected to the heating portion 4 and rounds about the sequentially arranged steel plates 5, and when the heated oil flows, the temperature in the steel plates 5 rises. When cool air flows through the steel plates 5, air is warmed by the surfaces of the steel plates 5 and flows upwardly. The temperature of a room can thus be raised gradually by air convection.

The advantage of the aforesaid air convection electric heater is that the temperature of a room can be raised steadily, and more uniformly as compared to heat radiation electric heaters but convection electrical heaters have the following disadvantages.

Since oil is heated in advance and pumped to the steel plates to heat the plates before heat convection can start, heating is very slow.

Structurally, a connecting pipe line must be provided to deliver hot oil without oil leakage, and thus the problem of expanding oil after heating must somehow be overcome. The structure thereof is thus complicated and the assembly thereof is difficult and time consuming, adding to the cost of production.

Since oil leakage due to oil expansion must be prevented, and the absorption and scattering of the heat from the hot oil must be carefully monitored, steel plates made of hardened steel must preferably be used and sequentially spaced. Due to the increased weight of the steel plates in addition to the weights of the oil pipe, the pump and the oil itself, this type of electric heater is too heavy, and is thus difficult to move.

The fact that the heating portion 4 must be provided with a connecting pipe line for delivering hot oil, it is not easy to simply increase or decrease the number of the steel plates and the amount of oil to manufacture a heater for various specifications and suitable for various space sizes. It may not be economical to purchase more electric heaters to provide heat.

Among the above mentioned disadvantages, consumers are generally attentive to the slowness of heating and many users utilize a fan to spread heat of a convective electric heater. The cause of the slow speed of heating a room with an electric heater is due to the way in which oil is heated in advance and pumped to the steel plates. This is an indirect method of heat conduction, thus the speed of heating is very low. Adding a fan to the convective electric heater can increase the speed of air convection but this results in added noise generated by the fan as well as costs associated with the fan.

Heat radiating electric heaters are limited by their heating method. They can only increase the size and power of the quartz pipes, for instance to increase the area of radiation or increase the amount of light emitted, but they cannot improve on their efficiency. There is a need to effectively improved the design of electric heaters to provide an electric heater which can increase heating speed, and which is easy to assemble economically.

Some prior art references for heaters provide a background for the invention. In U.S. Pat. No. 4,541,408 upright hollow pipes are used as a fence in front of the opening for a fire-space in a room, in order to receive the radiation energy from the fire-space and convert the energy into heat and in order to heat the air contained in the pipes. The device provides heat from a fire-space and it is not available for use without a fire-space and it is fixedly positioned in front of the opening of the fire-space and cannot be moved to other areas in the house.

UK patent GB2261723A, discloses a heater device that provides a body portion 1 with a heating element 15 and a fan 18. The fan 18 draws out hot air that is heated by the heating element 15 in the body portion. The disadvantages of using a fan has been previously discussed.

U.S. Pat. Nos. 1,701,096, 1,731,472, 1,840,598 and 1,895,482 are complex in design and difficult to assemble. Heat generating pipes are embedded in the complicated body structures adding to the cost of assembly. The pipes cannot be easily moved after being connected to the heat sources.

U.S. Pat. No. 4,900,898 discloses a heater that provides elongated incandescent ultraviolet lamps and a fan in a case. The fan draws air to the incandescent ultraviolet lamps via a plurality of walls and then to the space that is to be heated. The deficiencies of this device is similar to that of UK patent GB2261723A since it needs the assistance of a fan to conduct hot air outwardly and to increase the convection of air.

U.S. Pat. No. 2,530,058 includes deficiencies similar to that of the aforementioned U.S. Pat. Nos. 1,701,096, 1,731,472, 1,840,598 and 1,895,482, and due to its complexity, the cost of assembly will be high.

U.S. Pat. No. 3,396,458 discloses an electric heater with heat sinking fins at the exterior of a heat emitting member. This device is not for household use.

SUMMARY OF THE INVENTION

The present invention overcomes the deficiencies of the prior art with novel improvements.

The structure of the convective electric heaters of the present invention includes a receiving chamber, a plurality of heat sink members, a plurality of electric heating pipes and a control portion. The receiving chamber and the heat sink members are formed from extruded aluminum plates. The heat sink members are sequentially arranged at both sides of the receiving chamber. The electric heating pipes are placed in the receiving chamber. The control unit causes the electric power source drive to emit heat. Heat energy from the electric heating pipes can be absorbed by the extruded aluminum plates that define the receiving chamber and heat can be conducted quickly to the heat sink members to exchange heat with ambient air by convection, so that the temperature of a room can be raised rapidly.

In the present invention, the receiving chamber and the heat sink members are both formed from extruded aluminum plates, that can thus be easily disassembled and assembled. The plates are light in weight, and conduct rapidly. The plates can absorb heat directly from the heat scattered by the electric heating pipes. Further, it is not necessary to use oil to deliver heat energy. The heat sink members are sequentially arranged at both sides of the receiving chamber and can increase the speed of air convection to raise the temperature of a room.

The receiving chamber and the heat sink members are formed from extruded aluminum plates that can easily be disassembled from and assembled with one another. The space of the receiving chamber is arranged to receive the electric heating pipes and the number of the heat sink members can be increased or decreased easily without changing the die for molding, thus lowering the cost of production. Hence consumers can select electric heater s of suitable specifications and desired room sizes at competitively lower prices.

Another object of the present invention is to provide a convective electric heater that is capable of increasing the speed of air convection. The heat sink members can be made of pipes so that the heat sink members can have the effect of chimneys. Cool air can be absorbed at the open ends of the, pipe-like heat sink members to exchange heat from the heat sink members and air is quickly released after it is warmed. The air molecules in a room with the inventive device can be excited and speed of air convection can be increased without providing a fan.

DETAILED DESCRIPTION OF THE PREFERRED EMBODIMENT

Figure 1:
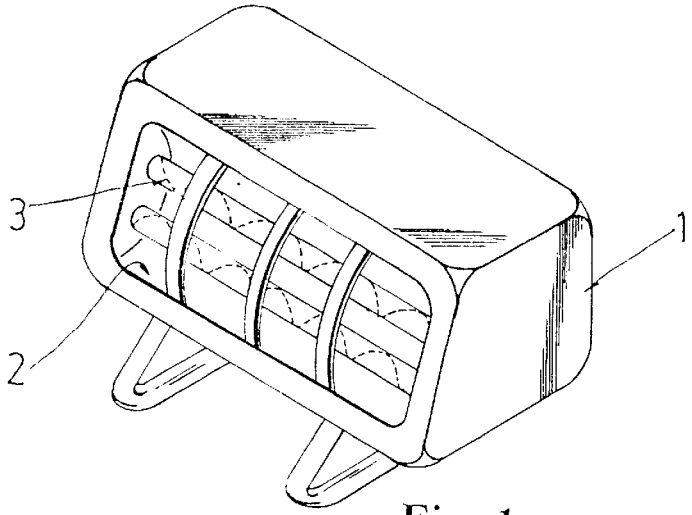
Fig. 1 PRIOR ART
FIG. 1 is a perspective view of a conventional heat radiating electric heater.
Figure 2:
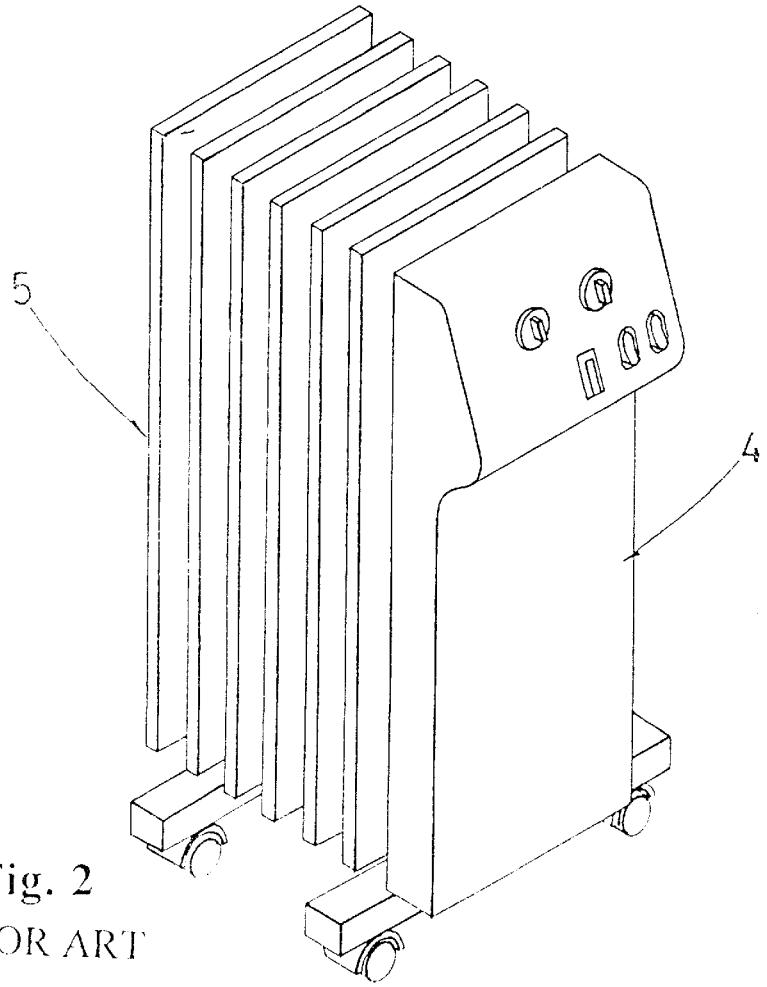
Fig. 2 PRIOR ART
FIG. 2 is a perspective view of a conventional convective electric heater.
Figure 3:
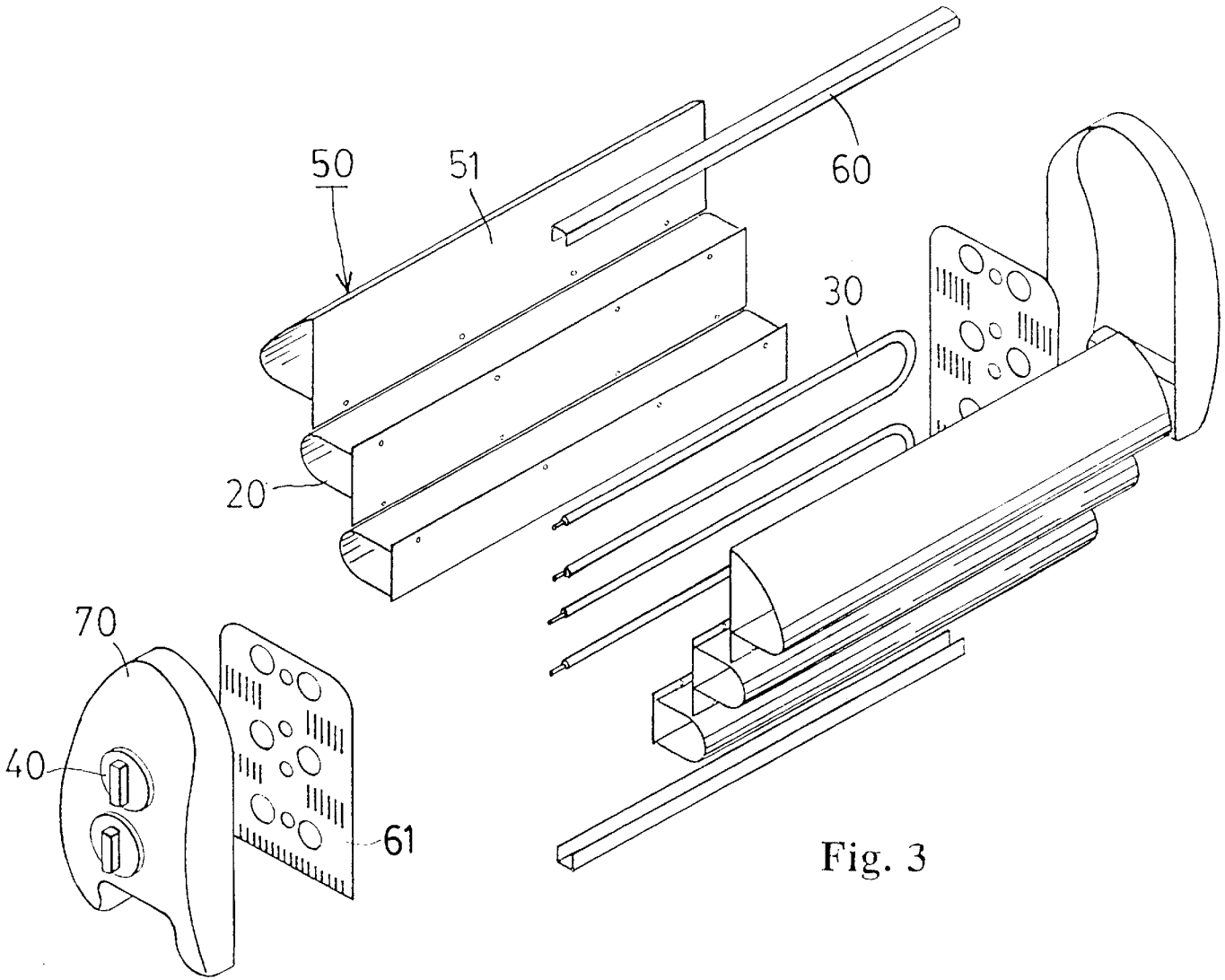
FIG. 3 is an exploded perspective view of the first embodiment of the present invention.
Figure 5:
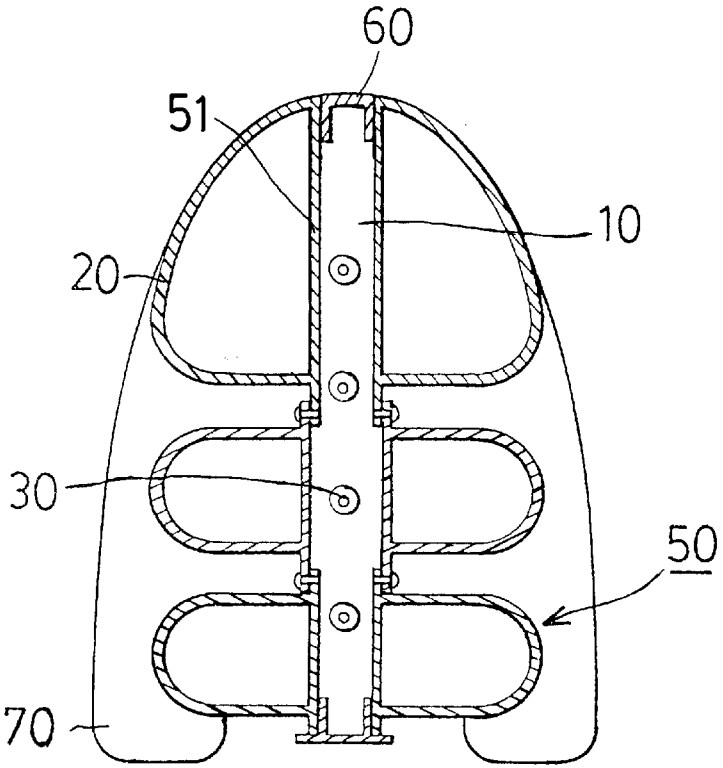
FIG. 5 is a sectional view of the first embodiment of the present invention.
Figure 4:
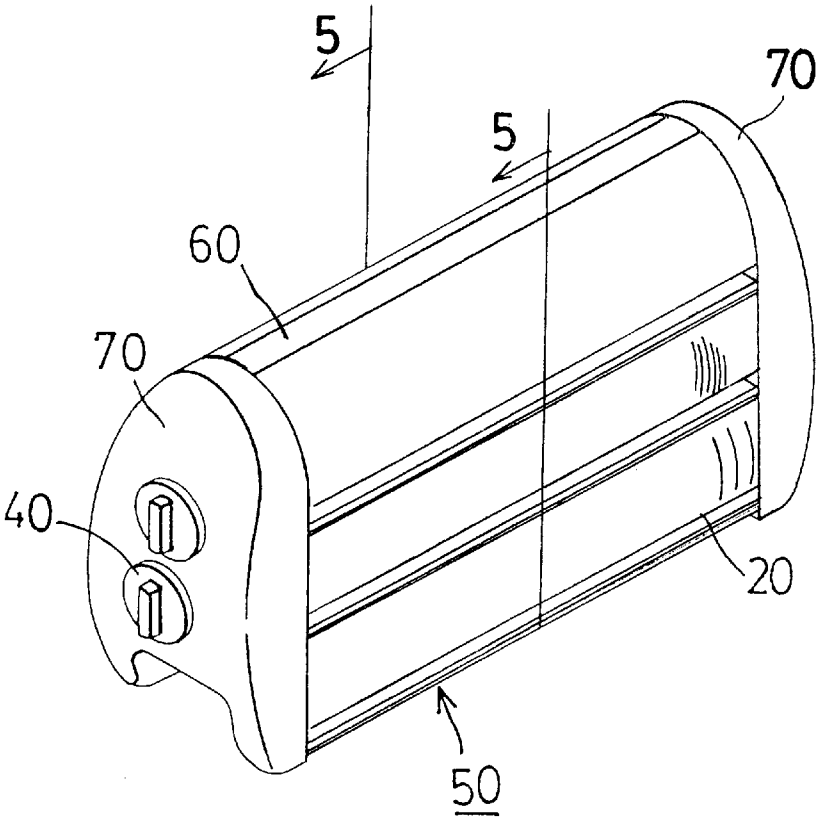
FIG. 4 is a perspective view of the first embodiment of the present invention.

FIGS. 3–5 show one embodiment of the present invention. The present invention includes a receiving chamber 10, and a plurality of heat sink members 20, both formed from extruded aluminum members. The heat sink members 20 are sequentially arranged at both sides of the receiving chamber 10. The electric heating pipes 30 are placed in the receiving chamber 10. The control unit 40 can power an electric power source to cause the emission of heat. Heat energy from the electric heating pipes 30 can be absorbed by the extruded aluminum plates that define the receiving chamber 10 and heat can be conducted rapidly to the heat sink members 20 so that ambient air is heated by convection. Thus, the temperature of a room utilizing the present invention can be raised rapidly.

In the first embodiment of the present invention, the receiving member 10 and the heat sink members 20 are formed from extruded aluminum connecting-members 50. A stop plate 51 is provided on the inner side of each connecting member 50, while the outer side of the connecting member 50 forms heat sink members, 20 having a "U" shaped section. The connecting members 50 are laid horizontally and connected one by one in rows and divided into a right and left groups. The stop plates 51 are vertically connected with one another in each group and form between the two groups an internal space which matches exactly the receiving chamber 10 for receiving the electric heating pipes 30. The heat sink members 20 are arranged on the outer sides of the receiving chamber 10.

A plurality of positioning members 60, 61 securely attach to the top, bottom, front, and rear end portions of the two planes formed by the stop plates 51 that are connected with one another in a vertical direction in two of the aforementioned groups as shown in FIGS. 3 and 5. Housing portions 70 are slipped over each of the front and the rear ends of the two connecting planes formed by the stop plates 51. A control unit 40 is provided on one the housing portions 70. The control unit 40 actuates the energization of the electric heating pipes 30, the power received from a power source such as a battery or electrical outlet (not shown).

The two lateral sides of the upper heat sink members 20 can tilt downwards so that articles such as combustible articles such as papers that are inadvertently placed on top of the heater can slide down to increase safety.

The shape of each of the heat sink members 20 is not limited to the "U" shape and plane shaped heat sink members can be effective as well.

Figure 6:
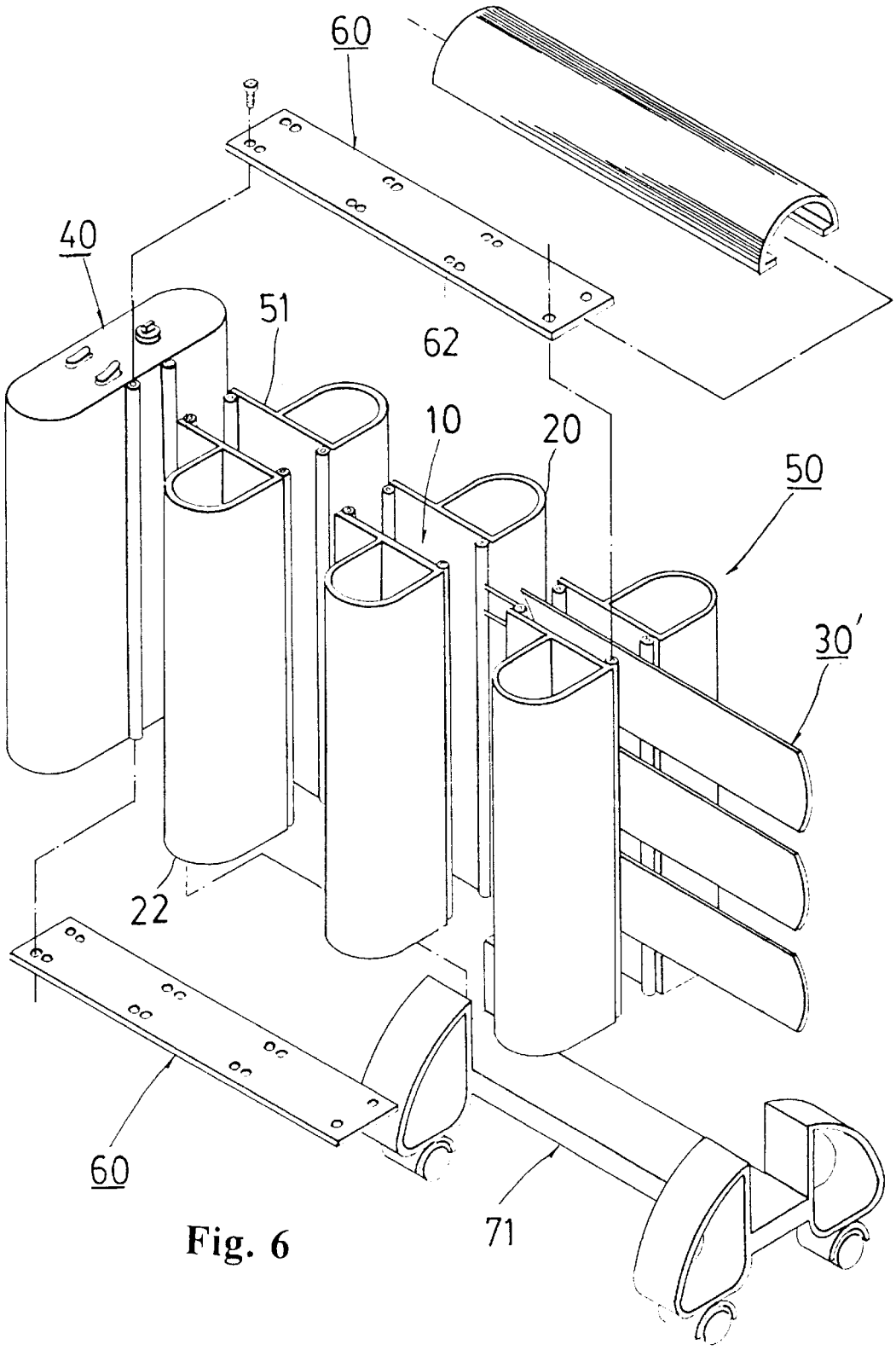
FIG. 6 is an exploded perspective view of the second embodiment of the present invention.
Figure 7:
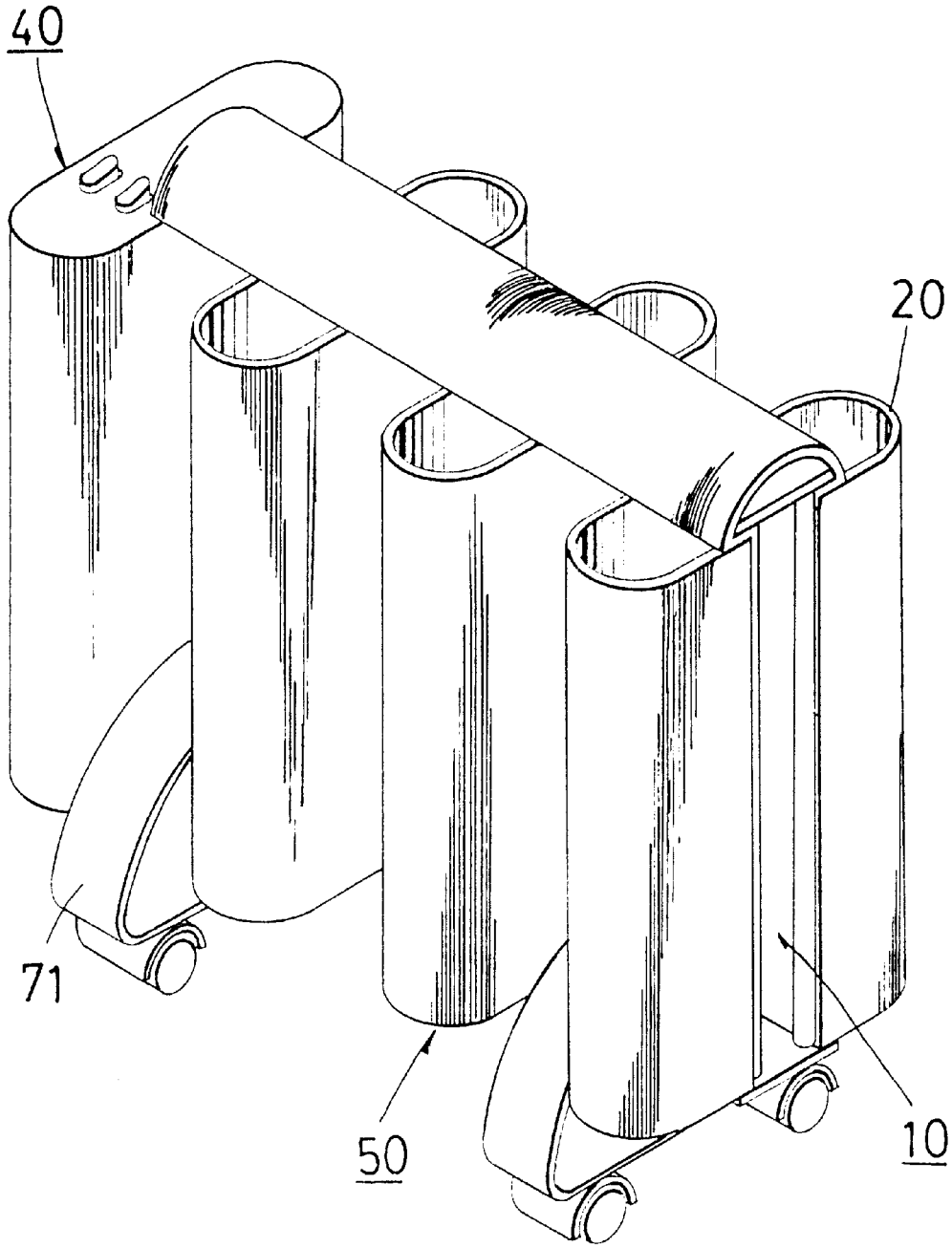
FIG. 7 is a perspective view of the second embodiment of the present invention.

FIGS. 6 and 7 show a second embodiment of the present invention, wherein the heat sink members 20 are also made from the extruded aluminum connecting members 50. Each connecting member 50 is provided on an inner side thereof with a stop plate 51. In this embodiment, the connecting members 50 are placed vertically and divided into two parallel groups. Positioning members 60 are secured on the top and bottom of the receiving chamber 10 defined by the stop plates 51.

Thus, the heat sink members 20 are in the shape of multiple upright positioned chimneys. The receiving chamber 10 is provided on one side thereof with a control unit 40. In this embodiment, the above mentioned electric heating pipes 30 can be substituted by equivalent electric heating sheets 30', and a base 71 with rollers can be provided on the bottom of the embodiment. Heat sink members 20 in the shape of multiple upright positioned chimneys can accelerate indoor air convection and raise the ambient temperature.

Figure 8:
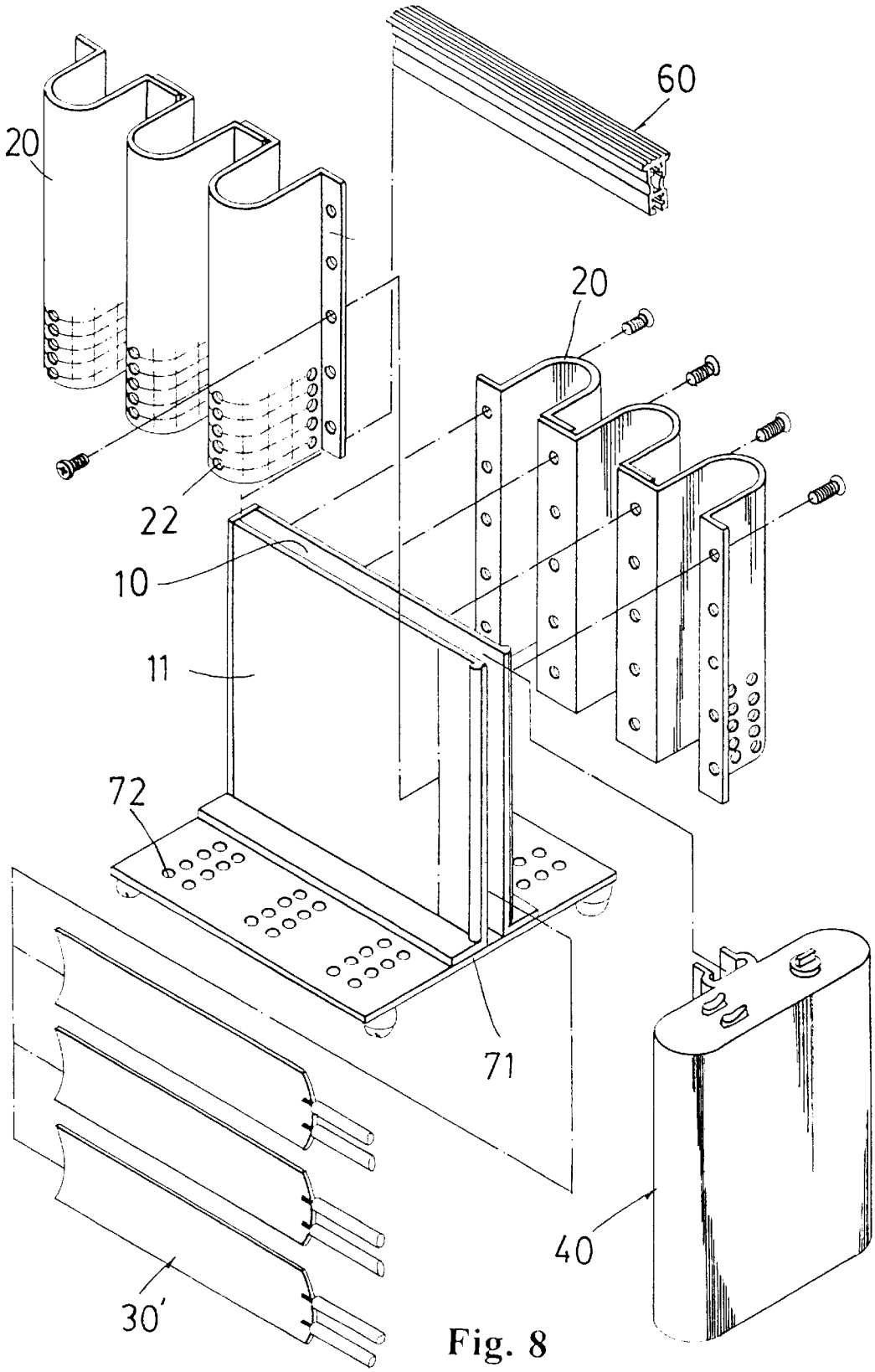
FIG. 8 is an exploded perspective view of a pipe of the third embodiment of the present invention.
Figure 9:
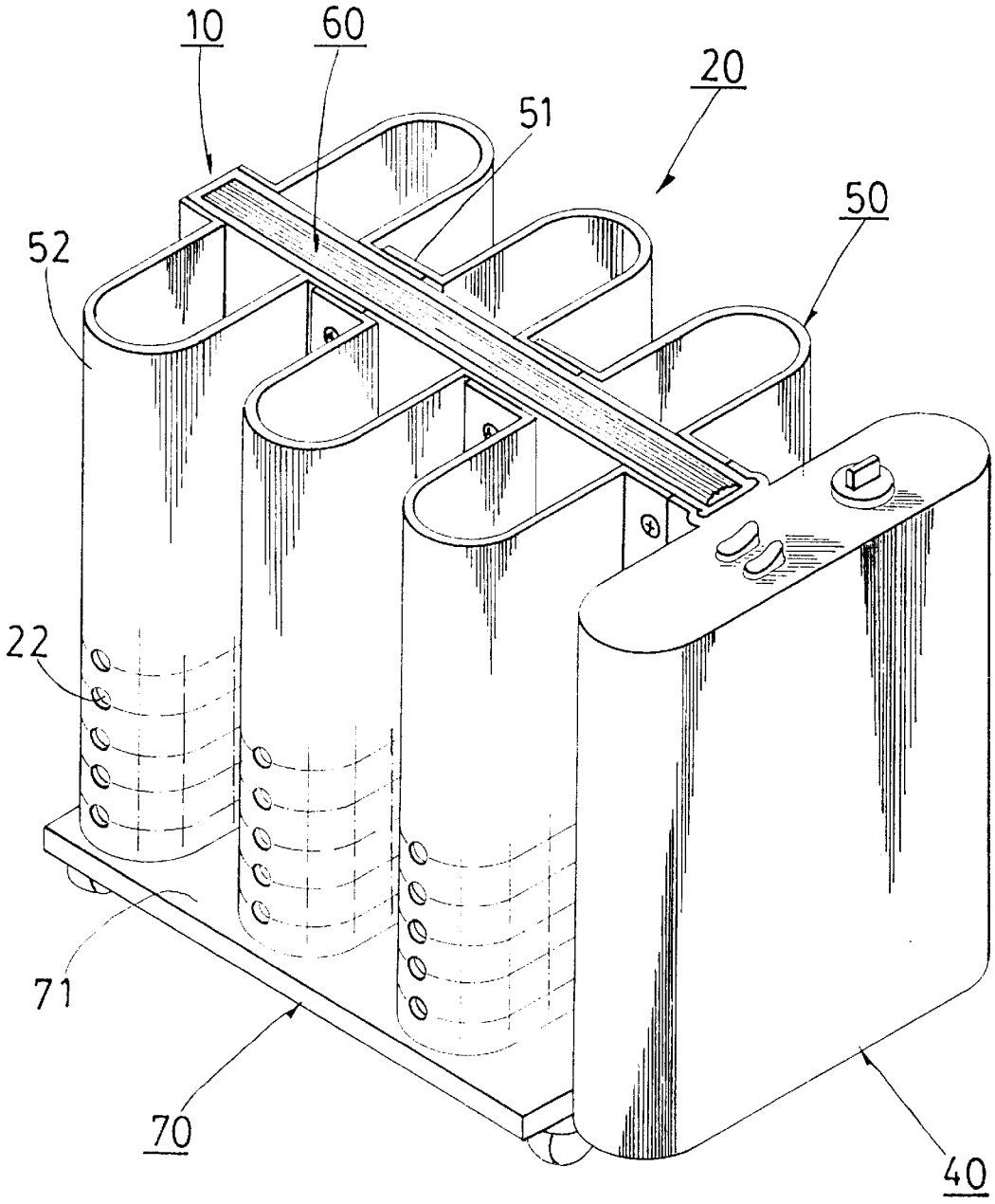
FIG. 9 is a perspective view of the third embodiment of the present invention.

FIGS. 8 and 9 show a third embodiment of the present invention, wherein the receiving chamber 10 and the heat sink members 20 are formed separately. The receiving chamber 10 is located at an upper center surface of the base 71 having rollers attached thereto and the receiving chamber 10 is defined by two parallelly upright walls 11 having an interspace therebetween and arranged to receive electric heating sheets 30'. A single positioning member 60 covers the interspace at the top of the upright walls 11. The heat sink members 20 are each made in a "U" shape and are placed vertically on the outer sides of the receiving chamber 10. A control unit 40 is provided on one side of the receiving chamber 10. In this embodiment, the heat sink members 20 are in the shape of multiple upright shaped chimneys in order to speed up convection of hot air. The base 71 can be a plane plate provided with air holes 72 to allow cool air to flow up through the holes and enter into the "U" shaped heat sink portions 20. In addition, the lower portions of the heat sink members 20 can also be provided with air holes 22 to draw in cool air into the heat sink portions 20.

Figure 10:
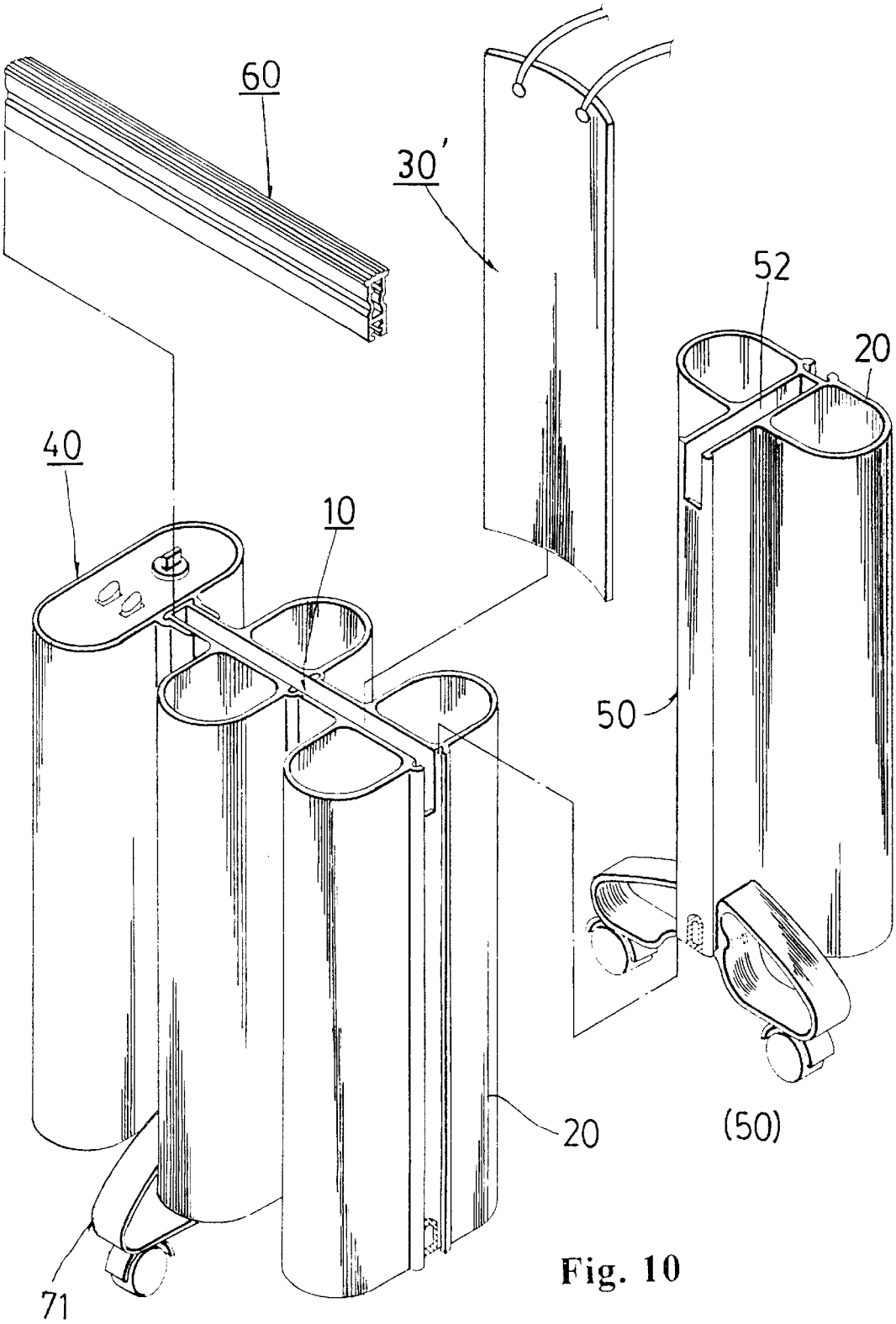
FIG. 10 is an exploded perspective view of the fourth embodiment of the present invention.

FIG. 10 shows a fourth embodiment of the present invention wherein the receiving chamber 10 is defined by the heat sink members 20 that are formed from extruded aluminum connecting members 50. Each connecting member 50 forms a central rectangular hollow pipe 52 therein, and a pair of "U"-shaped heat sink members 20 are formed on the two sides of the hollow pipe 52. The connecting members 50 are arranged horizontally and connected together and a positioning member 60 is positioned over the receiving chamber 10 to secure the connecting members 50. The rectangular hollow pipes 52 are arranged and connected to form a receiving chamber 10 that receives electric heating sheets 30'. The heat sink members 20 are arranged on the outer sides of the receiving chamber 10. A control unit 40 is provided on one side of the receiving chamber 10, and a base 71 can be provided on the bottom of the device to complete assembly.

Figure 11:
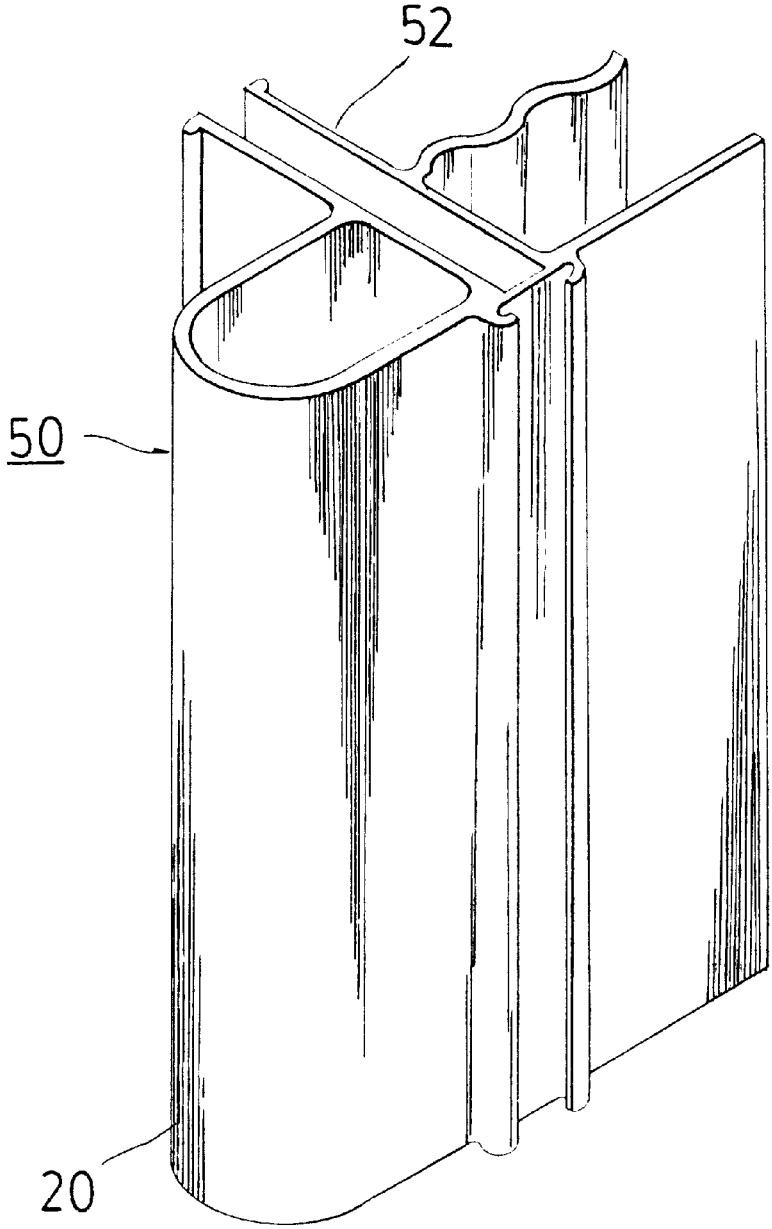
FIG. 11 is a perspective view of the fifth embodiment of the present invention.

FIG. 11 shows a fifth embodiment derived from the fourth embodiment of the present invention. The difference between the two embodiments is that the heat sink members 20 arranged on the outer sides of the rectangular hollow pipes 52 of the connecting members 50 are not all in the shape of a "U". The heat sink member 20 on one side of the corresponding rectangular hollow pipe 52 has a "U" shape, while the heat sink members 20 on the other side is in the form of plain planar plate or undulated plate. Both sides of the corresponding rectangular hollow pipe 52 may be in the form of plain plates or undulated plates.

Figure 12:
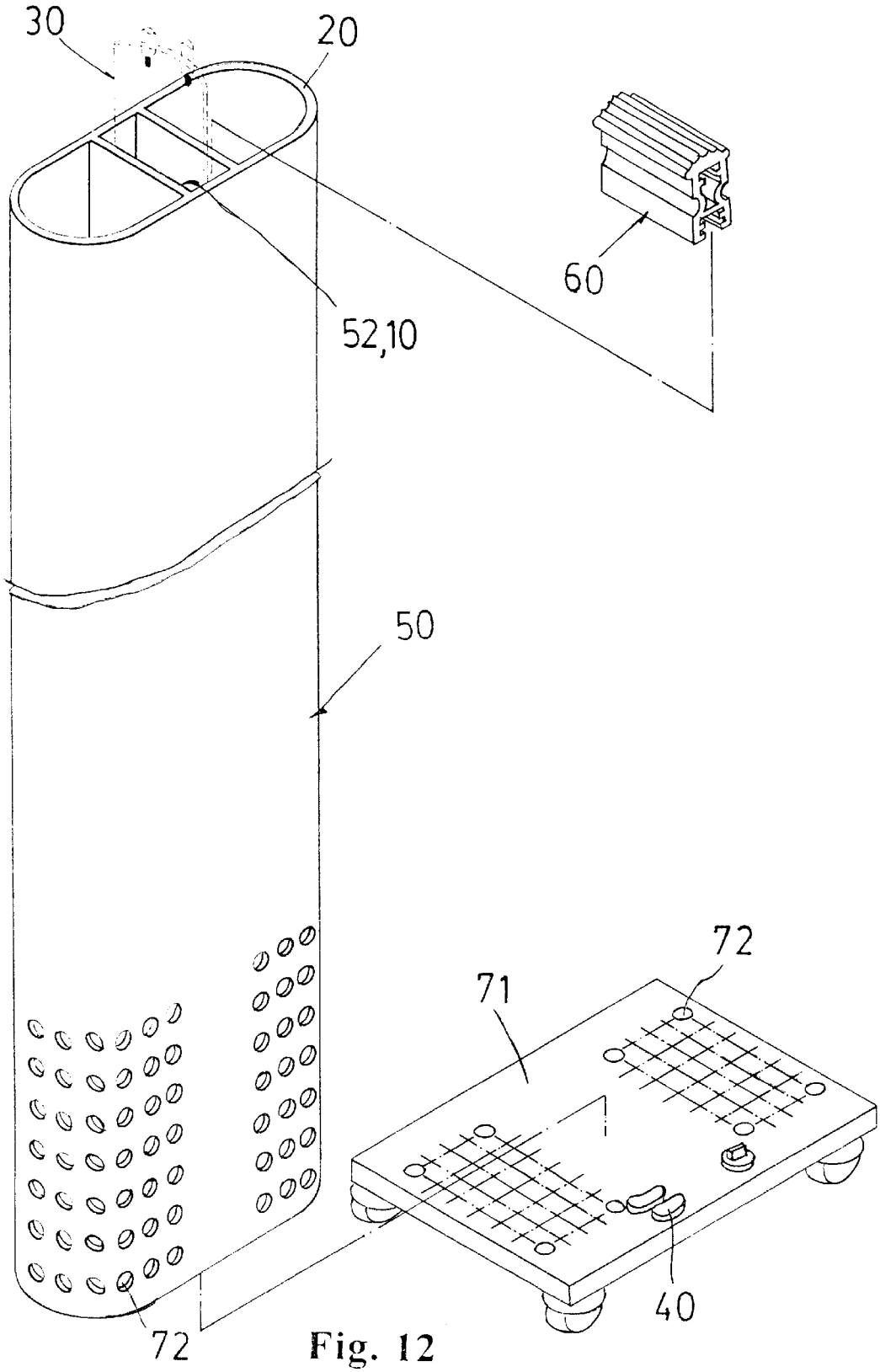
FIG. 12 is an exploded perspective view of the sixth embodiment of the present invention.
Figure 13:
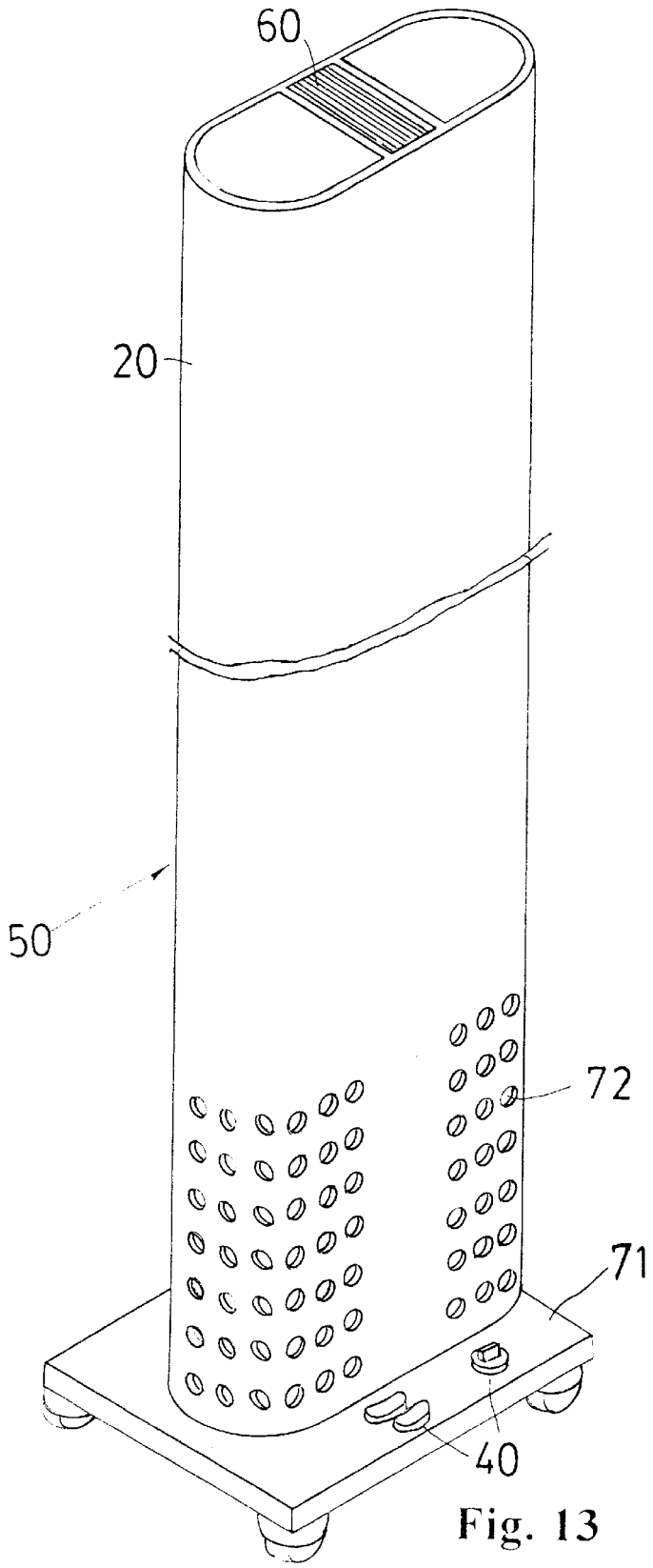
FIG. 13 is a perspective view of the sixth embodiment of the present invention.

FIGS. 12 and 13 show a sixth embodiment derived from the third embodiment of the present invention. Only one elongated connecting member 50 is provided and secured on a base 71 that is in the shape of a plain plate. The rectangular hollow pipe 52 in the connecting member 50 forms a receiving chamber 10 and receives one or more electric heating sheets 30'. Two heat sink portions 20 are formed on the outer sides of the receiving chamber 10. A control unit 40 provided on the base 71, and a positioning member 60 is provided on the top of the device to complete assembly. Additionally, the base 71 and the lower portion of the heat sink members 20 are both provided with air holes 72.

The names of the elements comprising the present invention and the shapes shown in the drawings are only for illustrating preferred embodiments of the present invention and are not for giving any limitation to the scope of the present invention. It will be apparent to those skilled in the art that various modifications or changes can be made to the elements of the present invention without departing from the spirit, scope and characteristic of this invention. Accordingly, all such equivalent modifications and changes also fall within the scope of the appended claims and are intended to form a part of this invention.

What is claimed is:

1. An electric heater comprising:

a control unit;

at least one positioning member;

a plurality of heat sink members each having a substantially U-shaped structure with ends that are attached to a flat plate to form a tubular structure with open ends, each of the flat plates including at least one stop plate extending therefrom along a plane of the flat plate;

the heat sink members sequentially and adjacently positioned on the positioning member to form two rows of the heat sink members, the flat plates of the heat sink members of one of the rows facing the flat plates of the other row of the heat sink members and spaced apart therefrom to define a receiving chamber, the stop plates preventing adjacent ones of the U-shaped structures from contacting one another; and one or more electric heating devices positioned in the receiving chamber and in communication with the control unit, the heating device connectable to a power source, the control unit arranged to activate the heating device, whereby heat emitted by the heating device is absorbed by the flat plates and conducted to the heat sink members which transfer heat to ambient air by convection.

2. The electric heater as claimed in claim 1, wherein the heating device is in the shape of a coiled pipe.

3. The electric heater as claimed in claim 1, wherein the heating device is comprised of one or more electrical heating sheets.

4. The electric heater as claimed in claim 1, wherein the heat sink members are shaped as multiple upright chimneys.

5. The electric heater as claimed in claim 1, wherein the positioning members includes a base on which the heat sink members are positioned to stand upright.

* * * * *